United States Patent [19]

Bannon

[11] 4,275,886

[45] Jun. 30, 1981

[54] GAME TARGET

[76] Inventor: Robert W. Bannon, 192 Afton Ave., Youngstown, Ohio 44512

[21] Appl. No.: 73,262

[22] Filed: Sep. 7, 1979

[51] Int. Cl.[3] ..... A63B 69/36

[52] U.S. Cl. ..... 273/178 R; 273/176 H

[58] Field of Search ..... 273/180, 195 R, 176 J, 273/176 FB, 177 R, 176 F, 176 B, 178 R, 178 A, 178 B, 178 H

[56] References Cited

U.S. PATENT DOCUMENTS

| | | | |
|---|---|---|---|
| 815,469 | 3/1906 | Smith | 273/178 R |
| 1,611,660 | 12/1926 | Manly | 273/178 B |
| 1,687,217 | 10/1928 | Kurtz | 273/176 B |
| 2,606,028 | 8/1952 | Zion | 273/176 F |
| 3,038,726 | 6/1962 | Hesidence | 273/195 R X |
| 3,669,454 | 6/1972 | Kolonel | 273/176 F |
| 3,843,136 | 10/1974 | Buenzle | 273/180 X |

FOREIGN PATENT DOCUMENTS

| | | | |
|---|---|---|---|
| 563781 | 7/1975 | Switzerland | 273/176 J |

*Primary Examiner*—George J. Marlo
*Attorney, Agent, or Firm*—Webster B. Harpman

[57] ABSTRACT

A game target provides an elevated surface with a target cup located centrally therein. A retaining wall is formed around three sides of the elevated surface with an approach ramp on the fourth side. The ramp and the elevated surface are separate abutting portions made of soft flexible foam. A soft carpet-like covering material is secured to both portions resulting in a motion absorbing non-rebounding target area, and the ramp being hinged to the elevated surface.

3 Claims, 2 Drawing Figures

GAME TARGET

BACKGROUND OF THE INVENTION (1) Field of the Invention:

This invention relates to target type games having elevated surfaces and cups therein.

(2) Description of the Prior Art

Prior structures of this type have utilized a variety of simulated surfaces such as golf greens and the like.

See for example U.S. Pat. Nos. 815,649, 1,611,660 and 2,606,028. U.S. Pat. No. 815,649 shows a sponge rubber body member level only in the center and tapered outwardly and downwardly in two directions.

Applicant's device is level in the entire target area and has a tapered ramp.

In U.S. Pat. No. 1,611,660 a putting green made of a hollow wedge shaped body having a surface fabric with a loop pile.

Applicant's device combines a foam base and a soft surface material.

In U.S. Pat. No. 2,606,028 a rigid base with a soft surface material is disclosed.

Applicant's device is a game target having a soft base and a soft carpet-like covering of smooth configuration, a cup centrally located therein.

SUMMARY OF THE INVENTION

A game target having an elevated target surface with a cup centrally located therein and walls of a soft foam material extending around a portion of the target area. An approach ramp on the remaining portion allows access thereto. The ramp and target area are formed of a soft foam material covered by a soft carpet-like fibrous material.

DESCRIPTION OF THE PREFERRED EMBODIMENT

Figure 1:
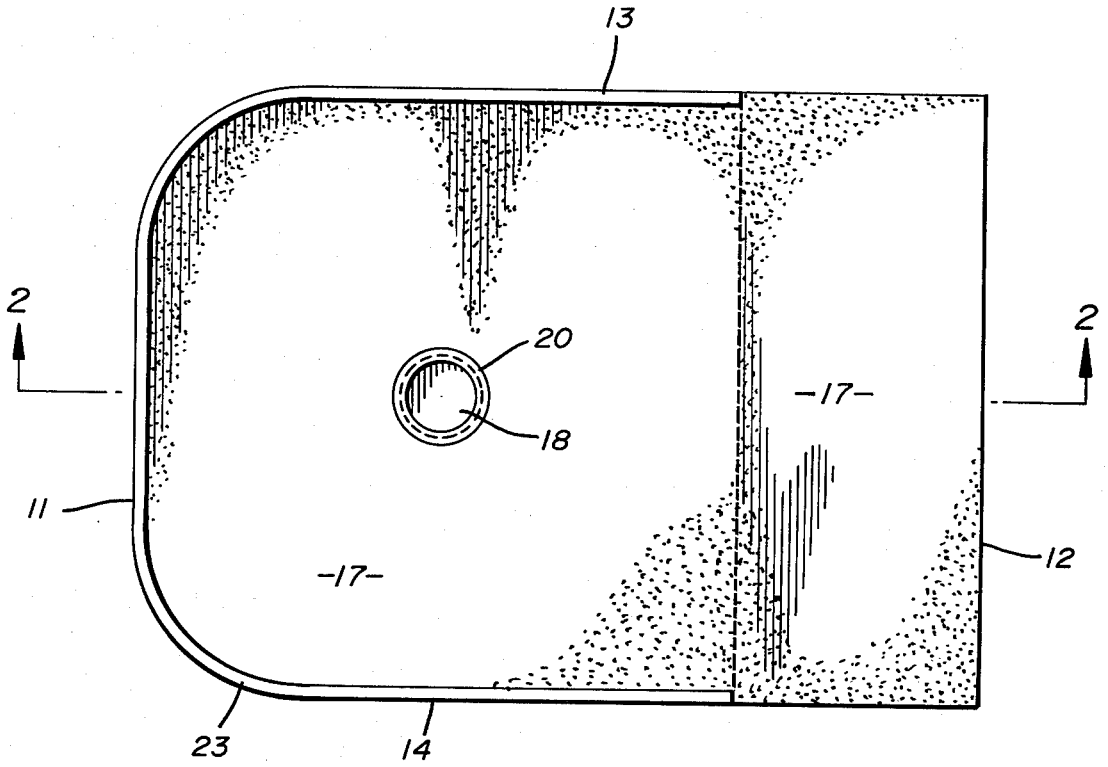
FIG. 1 is a top plan view of the game target.
Figure 2:
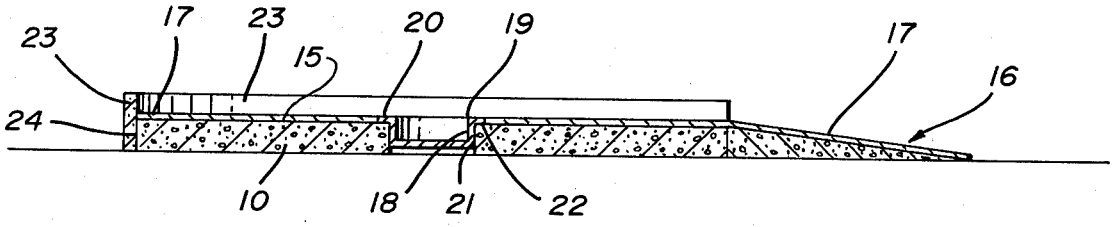
FIG. 2 is a sectional view on lines 2—2 of FIG. 1.

A game target as seen in FIGS. 1 and 2 of the drawings comprises a thick foam base 10 having a generally rectangular shape with ends 11 and 12, sides 13 and 14 and an elevated target surface 15. An access ramp 16 is formed on the end 12 of the base 10. A soft carpet-like material 17 extends over the entire target surface 15 and ramp area 16 and is fastened thereto as by cementing the same thereon. A cup 18 having an open upper end 19 has an annular flange 20 extending therefrom. The cup 18 is positioned in an opening 21 centrally located in the target surface 15 of the base 10. The annular flange 20 is positioned within a similarly shaped annular recessed area 22 in the soft carpet material 17 adjacent the opening 21 so as to support the cup thereon.

A foam strip 23 is secured to a perimeter edge portion 24 of the base 10 and the target surface 15 on the sides 13 and 14 and the end 11 thereof. The foam strip 23 extends above the target surface 15 forming a retaining wall in a U-shaped configuration as best seen in FIG. 1 of the drawings.

In use a golf ball rolled up onto the target surface 15 will rebound from the retaining wall foam strips 23 positioned around the three sides of the target surface, the rebound being limited.

Additionally, large metal or rubber washers can be tossed at the cup 18 in the target surface 15 and will not rebound.

The soft carpet-like material 17 can be one of several commercially available indoor-outdoor types such as Ozite brand.

The ramp 16 is preferably formed as a separate part of the game target and hinged thereto by the relatively thin soft carpet-like material which extends over the entire device.

It will thus be seen that a new and novel game target has been disclosed wherein a foam base provides an elevated game target area with flexible side walls and an access ramp all covered with a soft carpet-like material providing a resilient motion absorbing playing surface.

The device can be made simply and inexpensively and although but one embodiment of the present invention has been illustrated and described, it will be apparent to those skilled in the art that various modifications and changes may be made therein without departing from the spirit of the invention and having thus described my invention

What I claim is:

1. A game target device comprising a soft flexible foam base with an elevated flat target surface, an access ramp and a thin soft smooth covering on both the target surface and the access ramp, means securing the covering to the target surface and the access ramp, a cut in an opening in said target surface and base, the soft flexible foam of the base arranged to resiliently mount the cup in said opening, a U-shaped soft flexible foam retaining wall of a height greater than the height of said base secured to the peripheral edges of the base from each end of said access ramp so as to extend above said target surface, said access ramp formed of soft flexible foam.

2. The game target of claim 1 wherein said cup has an annular flange thereon extending outwardly and over said soft flexible foam base and registering in an opening in said thin soft smooth covering.

3. The game target of claim 1 wherein the base and the access ramp are separate portions positioned in engagement with one another and the thin smooth soft covering is secured to both portions so as to act as a hinge when the portions are moved relative to one another.

* * * * *